US009689155B2

(12) United States Patent
Shinohara et al.

(10) Patent No.: US 9,689,155 B2
(45) Date of Patent: Jun. 27, 2017

(54) FLUSH WATER VOLUME REGULATOR, FLUSH WATER TANK APPARATUS COMPRISING SAID FLUSH WATER VOLUME REGULATOR, AND FLUSH TOILET COMPRISING SAID FLUSH WATER TANK

(71) Applicant: TOTO LTD., Fukuoka (JP)

(72) Inventors: Koki Shinohara, Kitakyushu (JP); Hideki Tanimoto, Kitakyushu (JP); Jing Chen, Munakata (JP); Takashi Oogami, Kitakyushu (JP); Masateru Shiraishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 286 days.

(21) Appl. No.: 14/472,787

(22) Filed: Aug. 29, 2014

(65) Prior Publication Data

US 2015/0082529 A1 Mar. 26, 2015

(30) Foreign Application Priority Data

Sep. 24, 2013 (JP) ..... 2013-197055

(51) Int. Cl.
*E03D 1/00* (2006.01)
*E03D 1/22* (2006.01)
(Continued)

(52) U.S. Cl.
CPC ..... *E03D 1/34* (2013.01); *E03D 1/142* (2013.01)

(58) Field of Classification Search
CPC ..... E03D 1/34; E03D 1/142
(Continued)

(56) References Cited

U.S. PATENT DOCUMENTS 4,660,231 A 4/1987 McElfresh et al.
4,915,260 A 4/1990 Jones
(Continued)

FOREIGN PATENT DOCUMENTS

JP H05-087070 U 11/1993
JP 2001-323530 A 11/2001
JP 2012-102508 A 5/2012

OTHER PUBLICATIONS

The First Office Action issued by the Chinese Patent Office on Sep. 30, 2015, which corresponds to Chinese Patent Application No. 201410443835.4 and is related to U.S. Appl. No. 14/472,787; with English language comments.

*Primary Examiner* — Christine Skubinna
(74) *Attorney, Agent, or Firm* — Studebaker & Brackett PC

(57) ABSTRACT

A flush water volume regulator is provided, capable of constraining the occurrence of a buoyancy force acting on a water reservoir, whereby flush water in the water reservoir can be circulated with flush water in a flush water tank outside the water reservoir. The flush water volume regulator 38 of the invention has a water reservoir, being a water reservoir 40 disposed inside this flush water tank 16, capable of storing a predetermined amount of flush water, on which an opening 40*a* through which flush water within water reservoir 40 and flush water outside water reservoir 40 can pass, and an opening-closing valve 42 for opening 40*a* during the standby state before starting a flush and for blocking opening 40*a* or reducing the opening surface area of opening 40*a* when the water level inside flush water tank 16 is dropping after starting a flush.

7 Claims, 9 Drawing Sheets

(51) Int. Cl.
*E03D 1/34* (2006.01)
*E03D 1/14* (2006.01)

(58) Field of Classification Search
USPC ..... 4/363, 378, 415
See application file for complete search history.

(56) References Cited

U.S. PATENT DOCUMENTS 5,642,533 A * 7/1997 Young ..... E03D 11/13
4/325
6,173,456 B1 * 1/2001 Nieto ..... E03D 1/22
4/324

* cited by examiner

FLUSH WATER VOLUME REGULATOR, FLUSH WATER TANK APPARATUS COMPRISING SAID FLUSH WATER VOLUME REGULATOR, AND FLUSH TOILET COMPRISING SAID FLUSH WATER TANK

TECHNICAL FIELD

The present invention pertains to a flush water volume regulator, a flush water tank apparatus comprising said flush water volume regulator, and a flush toilet comprising said flush water tank, and in particular to a flush water volume regulator mounted on a flush water tank apparatus, capable of regulating the volume of flush water discharged to a toilet, and to a flush water tank apparatus comprising said flush water volume regulator, and to a flush toilet comprising said flush water tank.

BACKGROUND ART

With the demand in recent years for water conservation, the problem has arisen that in tank-type toilets, the reduction in the amount of flush water used to flush toilets has caused a drop in the water level head of flush water held in flush water tanks, weakening the force of flush water discharged from flush water tanks.

A known response to this issue has been to provide a water conserving tank with which flush water can be stored inside the flush water tank for supplying flush water to a toilet so as to cut the amount of flush water used in a single toilet flush without reducing the water level head, as set forth in Patent Document 1 (Specification of Unexamined Utility Model Application H05-87070), for example. Provided at the bottom of the side surface of this water conserving tank are a water discharge port for discharging flush water from the water conserving tank into the flush water tank when the interior of the flush water tank becomes empty, and an intake port at the top end of the side surface of the water conserving tank for intaking flush water into the water conserving tank, so that water can be exchanged such that water in the conserving tank does not stagnate.

SUMMARY OF INVENTION

Technical Problem

However, in a conventional water conserving tank such as that described in Patent Document 1, after the start of a flush the water level inside the flush water tank drops, and water inside the water conserving tank is discharged from a water discharge opening. When tank water is supplied after completion of the discharge operation, the level of water stored inside the flush water tank rises above the water level inside the water conserving tank, resulting in a water level differential; the water conserving tank is subjected to buoyancy force, with the resultant problem that it separates from its attachment position.

Also, in conventional water conserving tanks of the type described in Patent Document 1, the water conserving tank flush water intake port is placed at the top end of the side surface. Therefore when water is first supplied to an empty water conserving tank, such as during installation, or when a user holds the flush lever down for a long time period, the level of water stored inside the flush water tank rises above the level of water inside the water conserving tank, resulting in a water level differential, and the water conserving tank receives a buoyancy force, with the resultant problem that it separates from its attachment position.

The present invention was undertaken to solve the above-described problems with the conventional art, and has the object of providing a flush water volume regulator capable of suppressing the occurrence of buoyancy force acting on the water reservoir, and capable of circulating flush water inside the water reservoir with flush water inside the flush water tank outside the water reservoir.

Solution to Problem

To achieve the aforementioned object, the present invention is a flush water volume regulator capable of regulating the volume of flush water discharged to a toilet, disposed on a flush water tank apparatus having a water supply apparatus supplying water into a flush water tank from a water source for flushing a toilet, and a discharge valve apparatus for opening and closing a discharge flow path, disposed on the bottom surface of a flush water tank and communicating with a toilet; and being a water reservoir disposed inside the flush water tank capable of storing a predetermined quantity of flush water, having a water reservoir in which an opening is formed, through which flush water in this water reservoir and flush water outside the water reservoir can flow, and a opening-closing valve for blocking off the opening, or reducing the opening surface area thereof, in a state whereby the water level inside the flush water tank is dropping after a flush is started.

In the invention thus constituted, the opening-closing valve blocks off the opening or reduces the opening surface area when the water level in the flush water tank drops after starting a flush, therefore the drop in the level of flush water in the water reservoir can be constrained compared to the drop in the water level inside the water reservoir when no opening-closing valve is provided on the opening. Therefore in the present invention when the water supply apparatus supplies water and the water level inside the flush tank rises, the occurrence of a buoyancy force acting on the water reservoir can be constrained, and the floating up of the water reservoir and separation thereof from the attachment position as a result of being subjected to buoyancy force can be prevented. In the standby state before the opening-closing valve starts a flush, the opening is released, so flush water in the water reservoir can be circulated with flush water in the flush water tank outside the water reservoir.

Therefore the occurrence of a buoyancy force acting on the water reservoir can be constrained, and flush water in the water reservoir can be circulated with flush water in the flush water tank outside the water reservoir.

In the present invention an opening is preferably formed on the bottom surface of the water reservoir. In the present invention thus constituted, an opening is formed on the bottom surface of the water reservoir, therefore water pressure on the opening can act uniformly on the opening-closing valve, the opening-closing valve can be smoothly operated, and flush water inside the water reservoir can be reliably circulated with flush water inside the flush water tank outside the water reservoir.

In the present invention the opening in the water reservoir has an opening surface area (A1) such that the rise speed of the flush water level outside the water reservoir can be made approximately the same as the rise speed of the flush water level inside the water reservoir.

In the invention thus constituted, the opening in the water reservoir at the time of the first supplying of water when the flush water tank apparatus is first used has an opening surface area (A1) such that the rise speed of the flush water level outside the water reservoir can be made approximately the same as the rise speed of the flush water level inside the water reservoir, and flush water can flow through the opening into the water reservoir from the outside thereof. Therefore the present invention can suppress the occurrence of water level differences between the level of flush water outside the water reservoir and the level of flush water inside the water reservoir, the occurrence of buoyancy force acting on the water reservoir can be constrained, and the problem of the water reservoir rising due to buoyancy force and separating from the attachment position can be constrained.

In the present invention the opening surface area (A1) of the opening in the water reservoir is preferably made larger than the opening surface area (A2) between the opening-closing valve and the bottom surface of the water reservoir when the opening-closing valve releases the opening.

In the invention thus constituted, the flow of flush water seeking to flow from the water reservoir through opening surface area (A1) in the water reservoir is greater than the flow of flush water seeking to flow through the opening surface area (A2) between the opening-closing valve and the bottom surface of the water reservoir. Therefore the opening-closing valve is pulled onto the opening in the water reservoir, either closing off the opening or reducing the surface area of the opening.

In the present invention the opening-closing valve is preferably constituted of a member with a specific gravity lighter than water.

In the invention thus constituted, the opening-closing valve is constituted of a member with a lighter specific gravity than water, therefore the opening can be reliably released in a standby state before the start of a flush, and flush water in the water reservoir can be reliably circulated with flush water inside the flush water tank outside the water reservoir.

In the present invention a small hole connecting the inside and outside of the water reservoir is preferably formed in the opening-closing valve.

In the invention thus constituted, by forming a small hole in the opening-closing valve connecting the inside and outside of the water reservoir, flush water in the water reservoir can pass through this small hole and circulate with the exterior of the water reservoir even if the opening-closing valve on the water reservoir becomes stuck in a closed position and ceases to operate.

In the invention thus constituted, the water reservoir is preferably formed so that the top edge of the side surface of the water reservoir is positioned a predetermined distance above the expected full water level inside the flush water tank in a standby state before a flush is started, and the bottom edge of the side surface of the water reservoir is positioned a predetermined distance below the expected dead water level of flush water inside the flush water tank immediately after completion of a flush.

In the invention thus constituted, the top edge of the water reservoir side surface is positioned a predetermined distance above the expected full water level, and the bottom edge of the water reservoir side surface is positioned a predetermined distance below the expected dead water level. Therefore the full water level is disposed between the top edge and bottom edge of the water reservoir side surface, even if the full water level fluctuates up and down. Moreover, the dead water level is disposed between the top edge and bottom edge of the side surface of the water reservoir even if the dead water level fluctuates up or down. Therefore the present invention enables reliable regulation of the expected volume of flush water.

In the present invention the water reservoir preferably comprises a load support member for supporting the load of the water reservoir, in a position at the center of gravity on the bottom surface of the water reservoir.

In the invention thus constituted, the load support member supports the load of the water reservoir, and supports the water reservoir in a stable manner.

Next, the present invention is a flush water tank apparatus comprising a flush water volume regulator.

The invention thus constituted provides a flush water tank apparatus comprising a flush water volume regulator with which the occurrence of buoyancy force acting on the water reservoir can be constrained, and with which flush water inside the water reservoir can be circulated with flush water inside the flush water tank and outside the water reservoir.

Next, the present invention is a flush toilet comprising a flush water tank apparatus.

The invention thus constituted provides a flush toilet having a flush water tank apparatus comprising a flush water volume regulator with which the occurrence of buoyancy force acting on the water reservoir can be constrained, and flush water inside the water reservoir can be circulated with flush water inside the flush water tank and outside the water reservoir.

Advantageous Effects of Invention

According to the flush water volume regulator of the invention, the occurrence of buoyancy force acting on the water reservoir can be constrained, and flush water in the water reservoir can be circulated with flush water in the flush water tank outside the water reservoir.

DESCRIPTION OF EMBODIMENTS

Next, referring to the attached drawings, we explain a flush water volume regulator according to an embodiment of the present invention, a flush water tank apparatus comprising this flush water volume regulator, and a flush toilet comprising this flush water tank apparatus.

Figure 1:
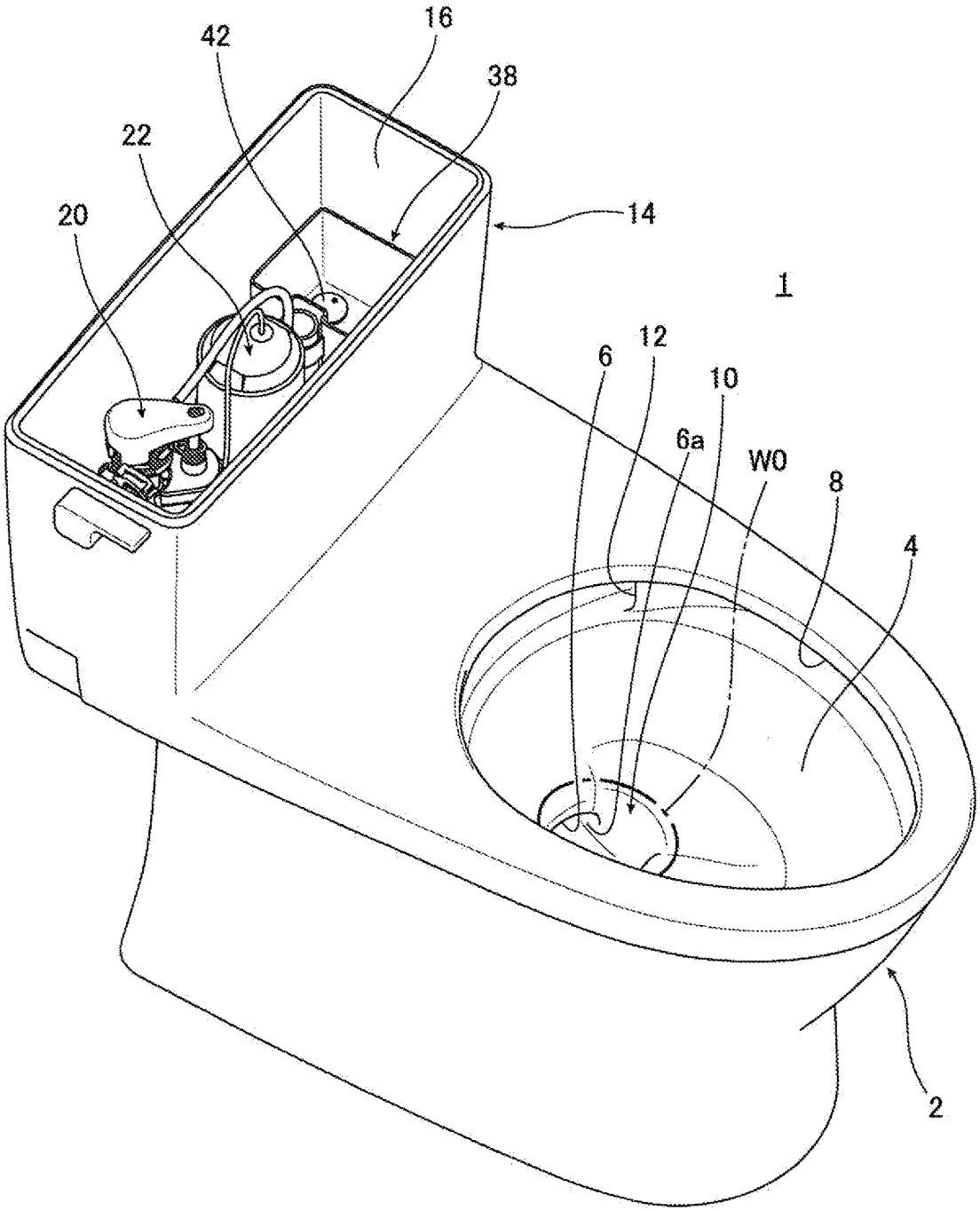
FIG. 1 is a perspective view of a flush toilet in which a flush water tank apparatus comprising a flush water volume regulator according to an embodiment of the present invention is applied, with the toilet seat, toilet cover, and flush water tank apparatus cover body removed.

First, using FIG. 1, we explain a flush toilet applying a flush water tank apparatus comprising a flush water volume regulator according to an embodiment of the present invention.

FIG. 1 is a perspective view of a flush toilet in which a flush water tank apparatus comprising a flush water volume regulator according to an embodiment of the present invention is applied, with the toilet seat, toilet cover, and flush water tank apparatus cover body removed.

As shown in FIG. 1, reference numeral 1 is what is known as a siphon type of flush toilet; this flush toilet 1 comprises a china toilet main unit 2; a bowl portion 4 and discharge trap conduit 6 communicating with the bottom portion of bowl portion 4 are respectively formed on the toilet main unit 2. Note that in addition to china, toilet main unit 2 may also be formed of resin and china, or of resin alone.

An inwardly overhanging rim 8 is formed on the top edge portion of the bowl portion 4 of toilet main unit 2, and a first spout port (not shown) for spouting flush water supplied from a water conducting path (not shown) formed in the interior of the rear side of toilet main unit 2 is formed at the left top of toilet main unit 2 bowl portion 4; flush water spouted from this first spout port (not shown) drops down as it swirls, thereby cleaning bowl portion 4.

A water accumulating portion 10, on which the accumulated water surface is indicated by dot-and-dash line W0, is formed at the bottom of bowl portion 4. A discharge trap conduit 6 inlet 6*a* is opened under said water accumulating portion 10, and discharge trap conduit 6 at the rear is connected through a discharge socket (not shown) from inlet 6*a* to an under-floor discharge pipe (not shown).

A second water spout port 12 for spouting flush water supplied from a water conducting path (not shown) formed in the rear side of toilet main unit 2 is formed at a position above the accumulated water surface W0 in bowl portion 4, and flush water spouted from this second water spout port 12 creates a swirling current which causes accumulated water in water accumulating portion 10 to swirl up and down.

A flush water tank apparatus 14 is provided on the top surface at the rear side of toilet main unit 2 for holding flush water supplied to toilet main unit 2. The flush water tank apparatus 14 is shown below with the cover body of the flush water tank apparatus removed.

Note that in this embodiment we explain an example in which flush water tank apparatus 14 is applied to the above-described siphon-type flush toilet, but the invention is not limited to such siphon-type flush toilets, and may also be applied to other types of flush toilets such as "wash-down" flush toilets or the like, in which waste is pushed out by the water flow action created by the water drop within the bowl portion.

Figure 2:
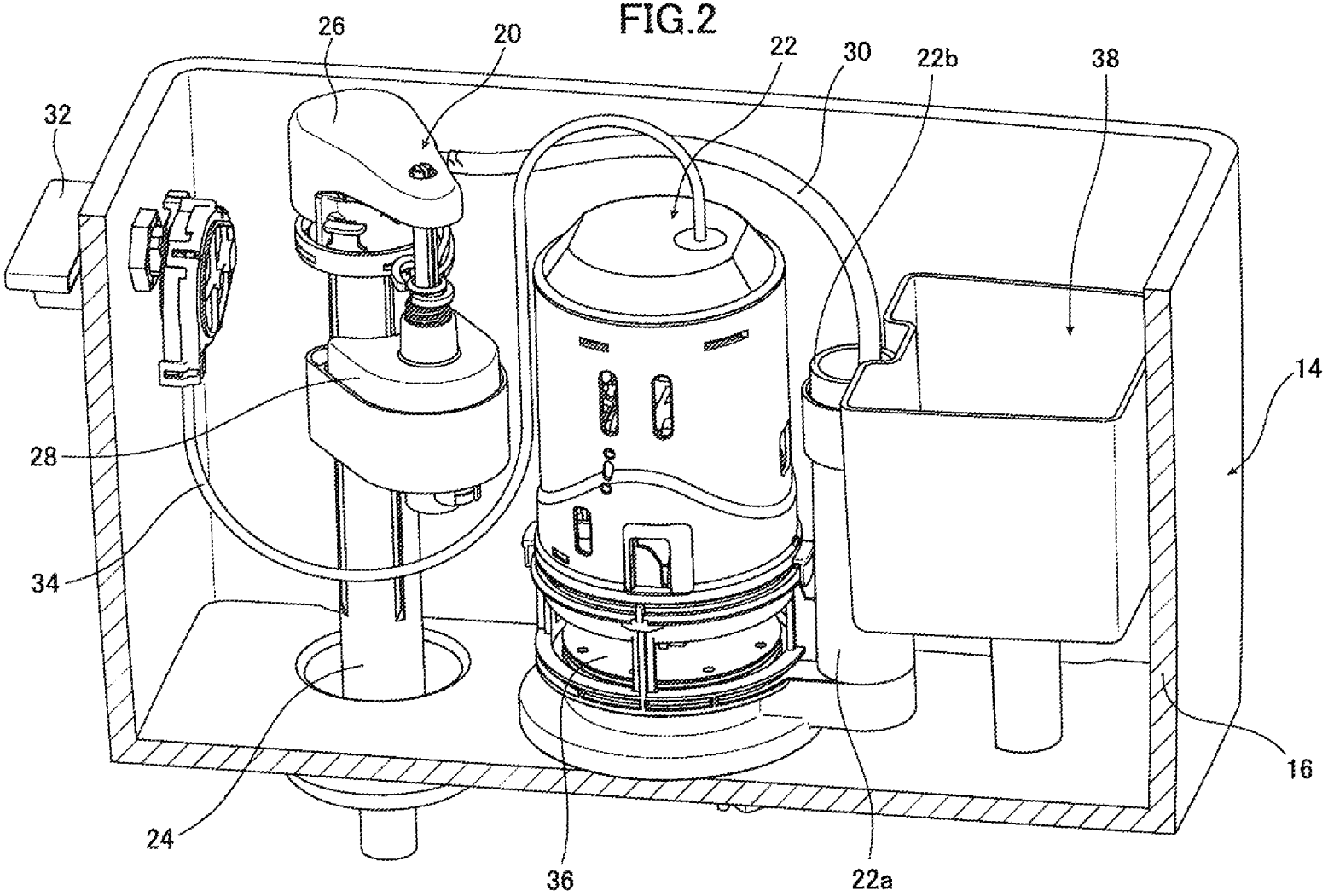
FIG. 2 is a perspective view showing the internal structure of a flush water tank apparatus comprising a flush water volume regulator according to an embodiment of the present invention.
Figure 3:
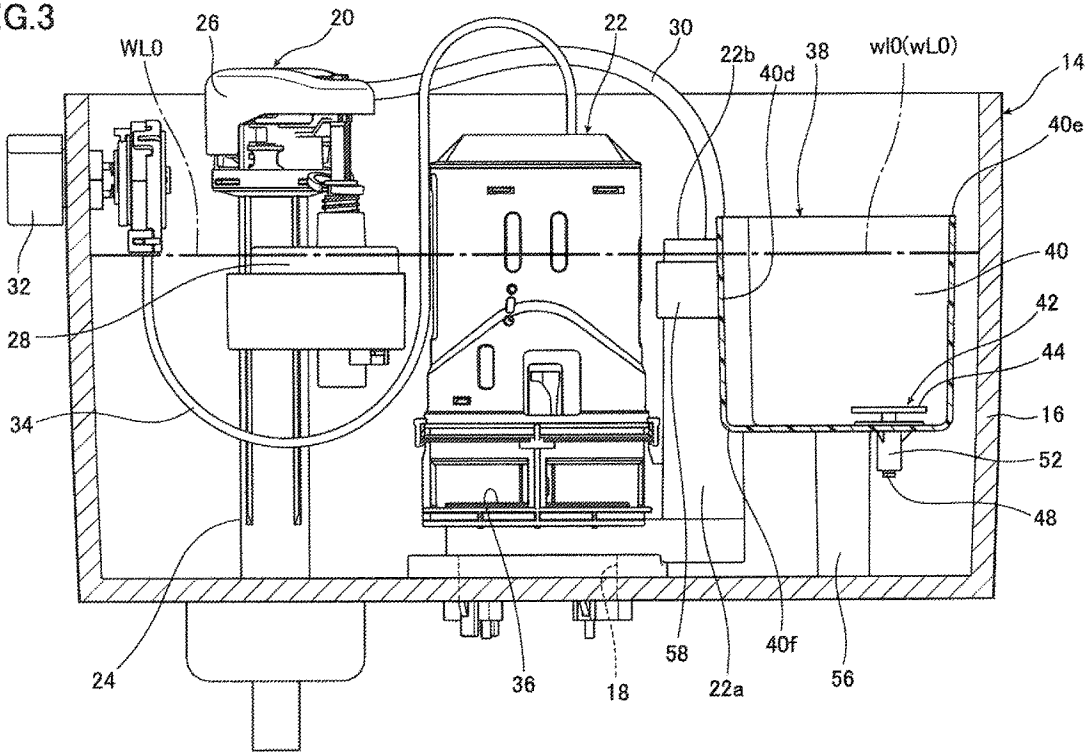
FIG. 3 is a front elevation cross section showing the internal structure of a flush water tank apparatus comprising a flush water volume regulator in a standby state, according to an embodiment of the present invention.

Next, referring to FIGS. 1 through 3, we explain the internal structure of flush water tank apparatus 14.

FIG. 2 is a perspective view showing the internal structure of a flush water tank apparatus comprising a flush water volume regulator according to an embodiment of the present invention; FIG. 3 is a front elevation cross section showing the internal structure of a flush water tank apparatus comprising a flush water volume regulator in a standby state according to an embodiment of the present invention.

Note that in FIG. 3, the full water level in the flush water tank is indicated by WL0; the water level inside the water reservoir is indicated by wl0 (in the standby state, the water level wl0 inside the water reservoir is the same as the flush water tank full water level WL0).

As shown in FIGS. 1 through 3, flush water tank apparatus 14 comprises a flush water tank 16, which is a flush water tank for storing flush water used to flush the flush toilet 1. A discharge port 18 communicating with the water conducting path (not shown) in toilet main unit 2 is formed on the bottom portion of this flush water tank 16. Flush water inside flush water tank 16 is supplied to the water conducting path (not shown) in toilet main unit 2. Also, flush water tank 16 is formed so that the amount of stored flush water differs depending on toilet type.

As shown in FIGS. 1 through 3, a flush water supply apparatus 20, being a flush water supply apparatus for supplying flush water into flush water tank 16 from a water supply source such as a municipal water supply, and a discharge valve apparatus 22 for opening a discharge port 18 for flush water stored in flush water tank 16 and releasing it to a water conducting path (not shown), are disposed inside flush water tank 16 on flush water tank apparatus 14.

Also, a vertically extending overflow pipe 22*a* is provided on the side of discharge valve apparatus 22, and the downward part inside this overflow pipe 22*a* communicates with discharge port 18. If by some chance the water level inside flush water tank 16 rises above full water level WL0 and reaches the top end opening portion 22*b* of overflow pipe 22*a*, flush water flowing in from the top end opening portion 22*b* on this overflow pipe 22*a* is discharged from discharge port 18 to the water conducting path (not shown) in toilet main unit 2.

Since flush water supply apparatus 20 has the same constitution as a conventional flush water tank apparatus, a specific explanation thereof is here omitted, but it comprises a water supply pipe 24 extending upward from the bottom portion of flush water tank 16 and connected to an external water supply source, a water supply valve 26 attached at the top end portion of this water supply pipe 24, and for switching between stopping and spouting water supplied from water supply pipe 24 into flush water tank 16, and a float member 28 for switching between spouting and stopping water from a water supply valve 26 moving up and down in response to fluctuations in the water level inside flush water tank 16.

A water spout port (not shown) is opened on the bottom end portion on the outer circumferential side of water supply pipe 24, and flush water from water supply valve 26 is spouted into flush water tank 16.

In addition, flush water supply apparatus 20 comprises a refill pipe 30 connected to water supply valve 26; the bottom end of this refill pipe 30 is positioned above top end opening portion 22*b* of overflow pipe 22*a* on discharge valve apparatus 22. Makeup water (refill water) supplied to refill pipe 30 from flush water supply apparatus 20 flows into overflow pipe 22*a* and is refilled as makeup water (refill water) to toilet main unit 2.

In flush water supply apparatus 20, when flush water inside flush water tank 16 is discharged by discharge valve apparatus 22, described below, the level of flush water drops and float portion 28 falls. This causes water supply valve 26 to open and water to begin spouting from the spout port, thereby starting the spouting into flush water tank 16. Next, as water spouting continues and the water level rises, float portion 28 also rises, causing water supply valve 26 to close, so that the spout port is opening-closing. This causes the flush water level inside flush water tank 16 to be maintained at a predetermined full water level.

Concerning the constitution of discharge valve apparatus 22, we here omit a specific explanation since it has the same constitution as conventional discharge valve apparatuses, but by rotating operating lever 32 attached to the outside of flush water tank 16 in a direction causing the execution of either the large flush or small flush predetermined flush modes, the operating wire 34 connected to operating lever 32 moves in tandem therewith and pulls discharge valve apparatus 22 discharge valve 36 upward. Discharge port 18 is thus opened for a predetermined time, and a certain amount of flush water inside flush water tank 16 is discharged to a water conducting path (not shown) in toilet main unit 2.

Next, referring to FIGS. 4 through 8, we discuss details of a flush water volume regulator according to an embodiment of the invention.

Figure 4:
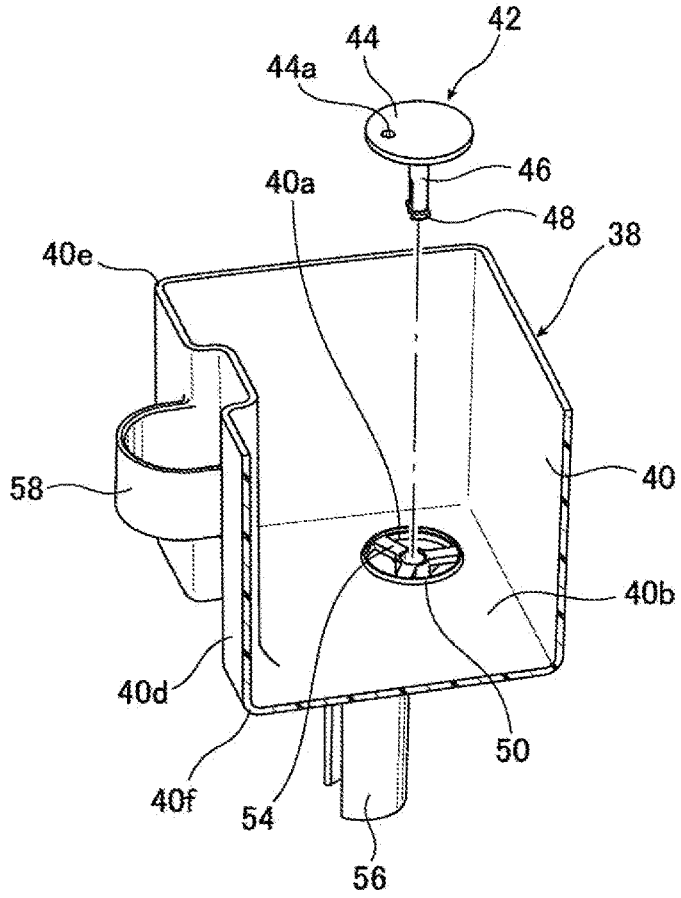
FIG. 4 is a partial exploded perspective view showing an exploded view of a opening-closing valve separated from a flush water volume regulator according to an embodiment of the present invention.
Figure 5:
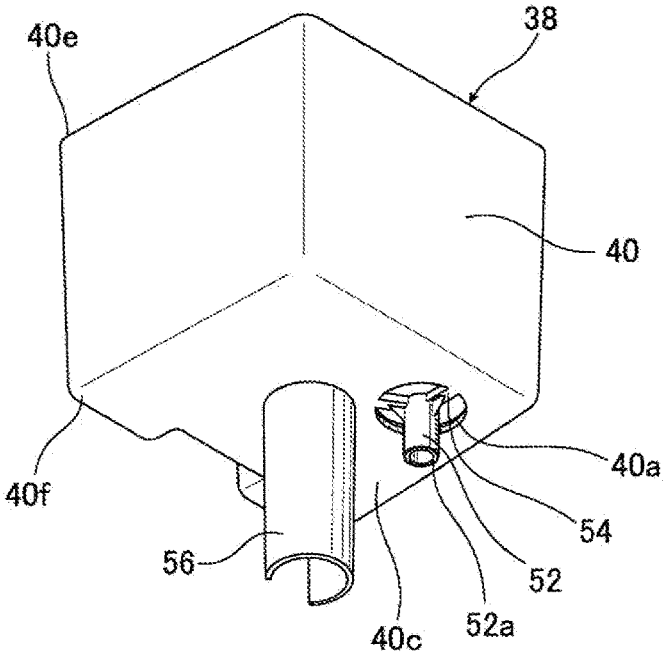
FIG. 5 is a perspective view seen diagonally from below on the front side of a flush water volume regulator according to an embodiment of the present invention, with the opening-closing valve removed.
Figure 6:
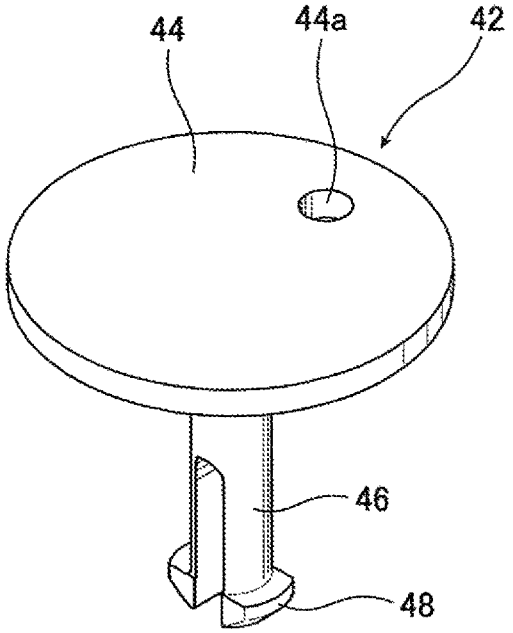
FIG. 6 is a perspective view showing the opening-closing valve on a flush water volume regulator according to an embodiment of the present invention.
Figure 7:
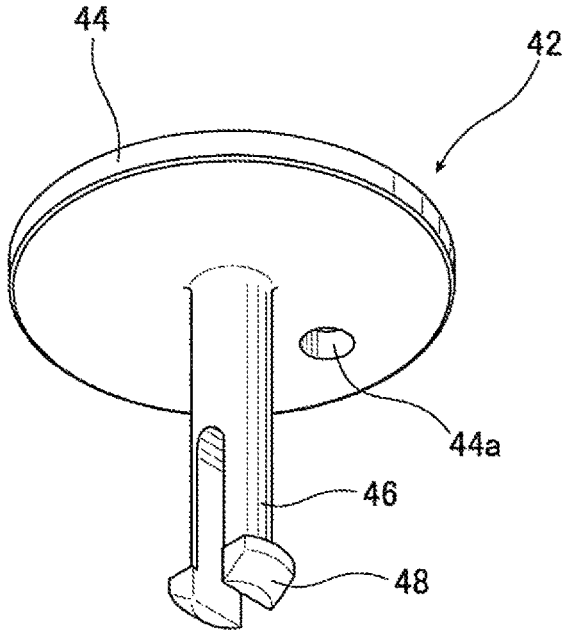
FIG. 7 is a perspective view seen diagonally from beneath the opening-closing valve on a flush water volume regulator according to an embodiment of the present invention.
Figure 8:
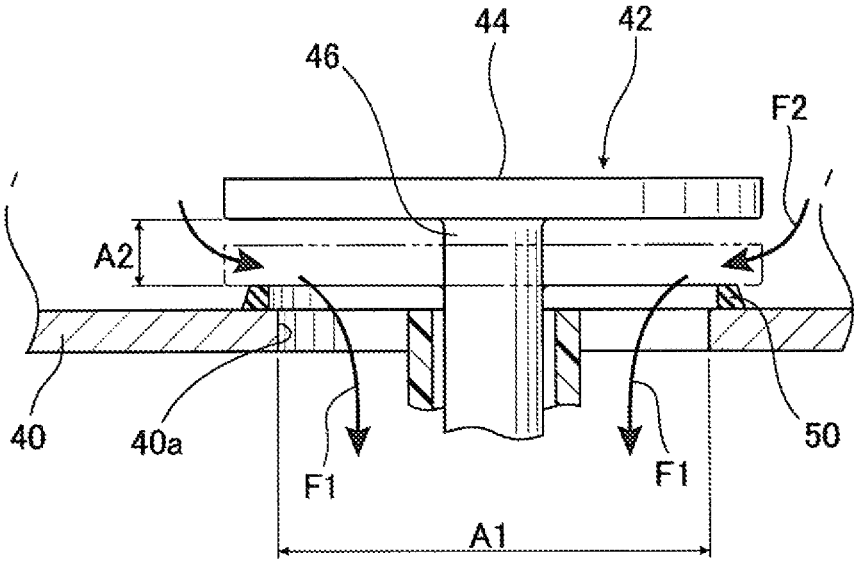
FIG. 8 is a partial expanded cross section in which the region of the opening in the water reservoir is expanded, with the opening-closing valve released, in a flush water volume regulator according to an embodiment of the present invention.

FIG. 4 shows an exploded view of a opening-closing valve separated from a flush water volume regulator according to an embodiment of the present invention, and is furthermore a partial exploded perspective view showing the internal structure by means of a cross section through a portion of the front side of the flush water volume regulator; FIG. 5 is perspective view seen diagonally from below on the front side, wherein the opening-closing valve is removed from the flush water volume regulator according to an embodiment of the present invention; FIG. 6 is a perspective view showing the opening-closing valve on a flush water volume regulator according to an embodiment of the present invention; FIG. 7 is perspective view seen diagonally from beneath the opening-closing valve on a flush water volume regulator according to an embodiment of the present invention; FIG. 8 is a partial expanded cross section in which the region of the opening in the water reservoir is expanded with the opening-closing valve released, in a flush water volume regulator according to an embodiment of the present invention.

Note that in FIG. 8, the flow of flush water seeking to flow out through the opening surface area (A1) of opening 40*a* is shown by arrow F1, and the flow of flush water seeking to flow out through the opening surface area (A2) between valve body 44 and sheet 50 is shown by arrow F2.

A flush water volume regulator 38 with which the volume of flush water discharged to a toilet can be adjusted to a desired volume is provided on the flush water tank 16 of flush water tank apparatus 14. The adjustment of flush water volume includes an adjustment by decreasing flush water volume using a flush water volume regulator, as well as an adjustment by increasing flush water volume by changing the size of the flush water volume regulator smaller.

A rectangular parallelepiped box-shaped form open at the top is formed on flush water volume regulator apparatus 38, and as shown in FIG. 3, the majority of the bottom side of this box-shaped form is disposed to be submerged in water under full water level WL0 in the standby state prior to the start of flushing. Therefore when flush water tank apparatus 14 performs a flush operation, the flush water volume regulator 38 can adjust the volume of water in a single flush discharged to toilet main unit 2 by not allowing discharge from flush water tank 16 of the volume of flush water in flush water volume regulator 38 corresponding to approximately the part from the full water level WL0 up to the dead water level DWL.

Thus by installing a flush water volume regulator 38 on a newly manufactured flush water tank apparatus 14, the volume of flush water discharged to toilet main unit 2 can be adjusted to reduce the flush water volume discharged to toilet main unit 2. Moreover, by additionally installing flush water volume regulator 38 on flush water tank apparatus 14, already installed on a toilet or wall, etc., a later adjustment can be made to reduce the volume of flush water discharged to toilet main unit 2.

Flush water volume regulator 38 has a water reservoir 40, being a water reservoir 40 disposed inside this flush water tank 16 and capable of storing a predetermined volume of flush water, on which an opening 40*a* is formed, through which flush water inside water reservoir 40 and flush water outside water reservoir 40 can flow. In addition, flush water volume regulator 38 releases opening 40*a* in the standby state prior to the start of a flush, and has a opening-closing valve 42 for blocking off opening 40*a*, or greatly reducing the opening surface area of opening 40*a*, when the water level inside flush water tank 16 is dropping after the start of a flush. I.e., compared to the opening surface area through opening 40*a* flow path when opening-closing valve 42 is releasing opening 40*a*, the opening surface area through opening 40*a* flow path is greatly reduced when opening-closing valve 42 is attempting to close opening 40*a*. The state in which opening-closing valve 42 reduces the opening surface area of opening 40*a* means the state in which opening-closing valve 42 operates in a direction to close opening 40*a*, either in the case when valve body 44 (described below) is in contact with a resin sheet portion 50 similar to the water reservoir but opening 40*a* cannot be completely blocked off and flush water flows out, or in the case when opening 40*a* cannot be completely blocked off due to the presence of a small hole 44*a* in valve body 44 (described below).

As shown in FIGS. 4 and 5, water reservoir 40 opening 40*a* is formed as a cylinder in a portion of the rear side of this bottom surface, and is formed to extend from the inside bottom surface 40*b* to the outside bottom surface 40*c*, causing the inside and outside of water reservoir 40 to communicate.

Opening-closing valve 42 comprises a disc-shaped valve body 44, a shaft portion 46 extending downward vertically from the center of the valve body 44, a hook portion 48 at the bottom end of shaft portion 46, a ring-shaped sheet portion 50 place on the outer circumference in the entry region on the inside bottom surface 40*b* side of water reservoir 40 opening 40*a*, a cylinder portion 52 for guiding shaft portion 46 so as to slide in the vertical direction through the inside, and three bridging portions 54 extending at an angle slightly downward from the inside surface of opening 40*a* toward the center of the opening 40*a*, affixing cylinder portion 52 to the center of opening 40*a*.

Here valve body 44, shaft portion 46, and hook portion 48 are integrally formed in opening-closing valve 42. Furthermore, in opening-closing valve 42 the shaft portion 46 thereof is slidably supported inside cylinder portion 52, such that opening 40*a* can be closed by bringing valve body 44 into contact with sheet portion 50, and opening 40*a* can be opened by separating valve body 44 and sheet portion 50. When shaft portion 46 rises by a predetermined distance relative to cylinder portion 52, hook portion 48 contacts the bottom end 52*a* of cylinder portion 52, and opening-closing valve 42 can be kept in an opened state.

Water reservoir 40 opening 40*a* has an opening surface area (A1) of sufficient size that the speed at which the level of flush water supplied by flush water supply apparatus 20 rises outside water reservoir 40 can be made essentially the same as the speed at which the level of flush water rises inside water reservoir 40. Because water reservoir 40 opening 40*a* has a sufficiently large opening surface area (A1), differences in water level between the flush water level outside water reservoir 40 and the flush water level inside water reservoir 40 can be constrained, and floating upward through the action of buoyancy force on water reservoir 40 can be constrained. Note that the speed of the rise of the flush water level inside flush water tank 16 is determined by the amount of the supply flow volume from flush water supply apparatus 20 and the size of flush water tank 16. The speed of the rise of the flush water level inside water reservoir 40 is determined by the volume of flush water inflow from opening 40*a* and by the size of water reservoir 40.

In addition, the round opening surface area (A1) of opening 40*a* on water reservoir 40 is formed to be larger than the cylindrical outer circumference-shaped opening surface area (A2) between the valve body 44 of opening and closing valve 42 and the sheet portion 50 on the inside bottom surface 40*b* of water reservoir 40 when opening-closing valve 42 opens opening 40*a*. Therefore when the water level inside flush water tank 16 is falling, the volume of flush water able to pass through opening surface area (A1) is greater than the volume of water able to pass through opening surface area (A2).

Valve body 44, shaft portion 46 and hook portion 48 in opening-closing valve 42 are constituted by members with a specific gravity lighter than water (flush water); e.g., a resinous member such as polypropylene with a specific gravity of 0.9 relative to water.

A small hole 44*a* communicating between the inside and outside of water reservoir 40 is formed on the valve body 44 of opening-closing valve 42. When opening-closing valve 42 is in a closed state, bridging portions 54 are slightly downward-inclined toward the center and a gap space is formed between valve body 44 and bridging portions 54, so that communication can be secured between the inside and outside of water reservoir 40 even when small hole 44*a* is positioned at the top of bridging portions 54. Note that communication between the inside and outside of water reservoir 40 can also be secured by forming small hole 44*a* on the bottom surface of water reservoir 40.

Water reservoir 40 is formed so that the top edge 40*e* of side surface 40*d* extends approximately 5 mm further up than the expected full water level WL0 in flush water tank 16 during the standby state before starting a flush. Water reservoir 40 is also formed so that the bottom edge 40*f* of side surface 40*d* extends approximately 5 mm below the expected dead water level of flush water DWL (the dead water level when in large flush mode) inside flush water tank 16 immediately after completion of a flush. Therefore water reservoir 40 is formed so that even if some fluctuation in full water level WL0 or dead water level DWL occurs due to usage environment, etc., full water level WL0 and dead water level DWL will be positioned on the side surface 40*d* of that box shape.

At the position of the center of gravity on outside bottom surface 40*c* of water reservoir 40, water reservoir 40 comprises a load support member 56 for supporting the load of water reservoir 40 and flush water therein, and a U-shaped attachment portion 58 extending horizontally from the side surface 40*d* of water reservoir 40. This load support member 56 is formed in a cylinder with a C-shaped cross section from which part of the cylinder is cut out; at the bottom end thereof, the projection protruding from flush water tank 16 is affixed by being internally received. Load support member 56 is able to maintain water reservoir 40 at a certain height rising vertically from the bottom surface of flush water tank 16. Attachment portion 58 is a half ring-shaped member which can be attached between attachment portion 58 and side surface 40*d* so as to cover the outside perimeter of overflow pipe 22*a*. Flush water volume regulator 38 can be easily attached from above to position overflow pipe 22*a* on the inside of attachment portion 58. In addition to being an annular ring, attachment portion 58 can also be a snap-fit sandwiching overflow pipe 22*a*, or a ring-shaped clip fitting onto the top portion of overflow pipe 22*a*.

Next, referring to FIGS. 2 through 11, we explain a process for manufacturing a flush water tank apparatus 14 comprising flush water volume regulator 38 according to an embodiment of the invention.

Figure 11:
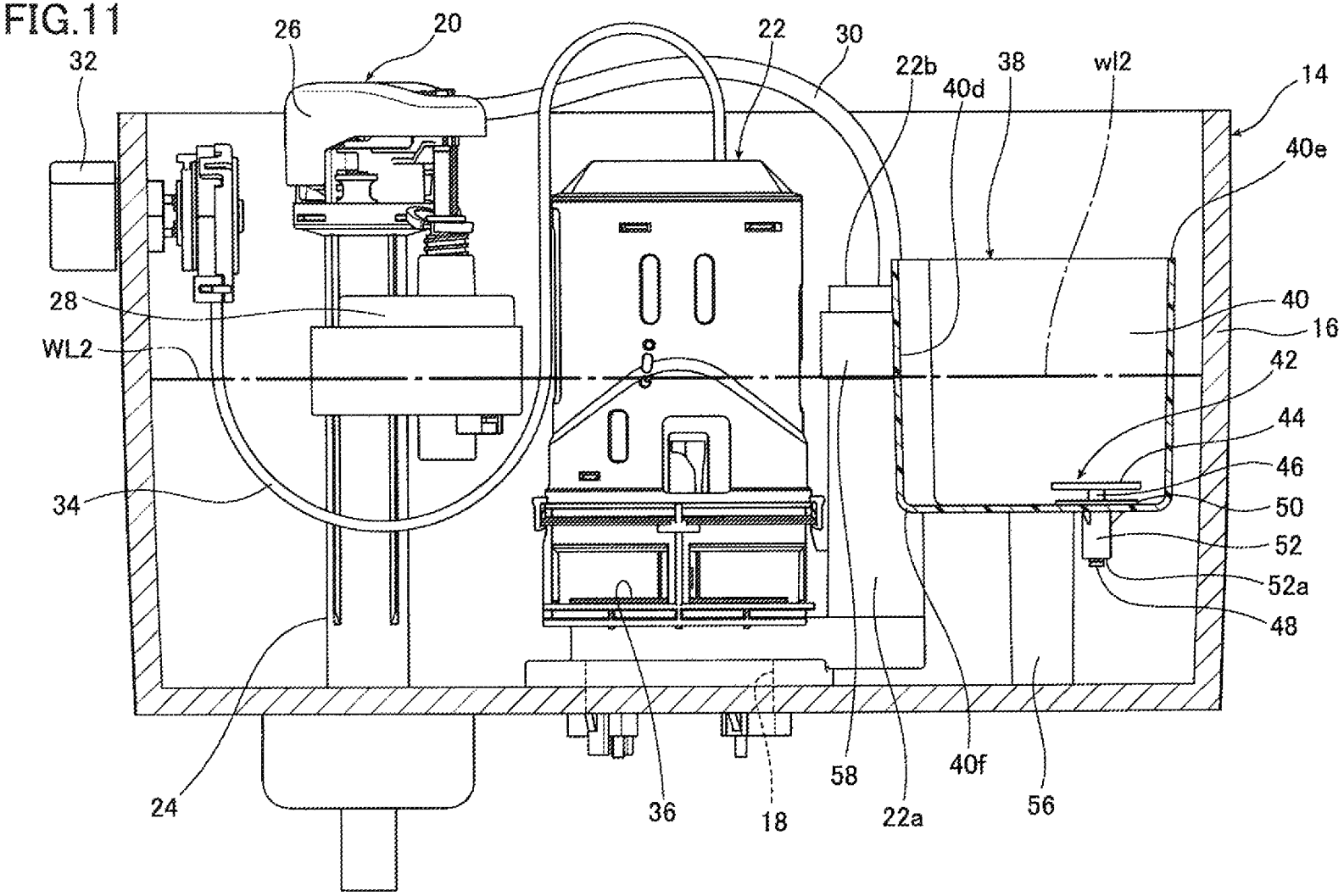
FIG. 11 is a front elevation cross section showing a flush water tank apparatus comprising a flush water volume regulator according to an embodiment of the present invention, when changing from an empty state in which no flush water is stored, to the first supplying of water.

FIG. 11 is a front elevation cross section showing a flush water tank apparatus comprising a flush water volume regulator according to an embodiment of the present invention, when changing from an empty state in which no flush water is stored, to the first supplying of water.

The process for manufacturing a flush water tank apparatus 14 comprising a flush water volume regulator apparatus 38 of the present invention has a step for preparing a flush water tank apparatus 14 having a flush water supply apparatus 20 for supplying flush water for flushing toilet main unit 2 from a water source into flush water tank 16, and a discharge valve apparatus 22 disposed on the bottom surface of flush water tank 16 for opening and closing a water conducting path communicating with toilet main unit 2; and a step for attaching flush water volume regulator 38 to flush water tank apparatus 14. Here the step for preparing flush water tank apparatus 14 includes a preparation step so that flush water volume regulator 38 can be attached to flush water tank apparatus 14 already installed on flush toilet 1 and in use.

Moreover, a flush toilet 1 having a flush water tank apparatus 14 comprising flush water volume regulator 38 can also be manufactured by adding a stage for attaching flush water tank apparatus 14 to flush toilet 1 at any point in time.

In the attachment step above, with the flush water tank apparatus 14 cover being in an open state, flush water volume regulator 38 can be easily attached from above to overflow pipe 22*a*. Flush water volume regulator 38 is attached to overflow pipe 22*a* by attachment portion 58, and the position at which it is supported on the bottom surface of flush water tank 16 by load support member 56 is selected as the position of attachment.

Because flush water volume regulator 38 has the function of suppressing the occurrence of buoyancy force acting on water reservoir 40, steps for strongly affixing overflow pipe 22*a* or other members in order to resist buoyancy force can be omitted, and an easy attachment to overflow pipe 22*a* can be achieved.

Thus flush water volume regulator 38 according to an embodiment of the invention, while enabling simple attachment to flush water tank apparatus 14 so that flush water volume can be regulated to a predetermined volume, is capable of suppressing the occurrence of buoyancy force acting on water reservoir 40, and of circulating flush water inside water reservoir 40 with flush water in flush water tank 16 outside water reservoir 40.

Next, referring to FIG. 11, we explain the operation of flush water volume regulator 38 after the above-described flush water volume regulator 38 is attached to flush water tank apparatus 14, at the time of the first supply of water.

After flush water volume regulator 38 is attached to flush water tank apparatus 14, water reservoir 40 is in an empty state with no flush water stored therein prior to first supply of flush water into flush water tank 16.

When flush water supply apparatus 20 first fills water into flush water tank 16, as the supply of water is started and the water level rises, flush water can be flowed in through opening 40*a* from outside water reservoir 40 so that the rise speed of the flush water level supplied by flush water supply apparatus 20 outside water reservoir 40 and the rise speed of the flush water level inside water reservoir 40 are approximately the same speeds. Therefore differences in water level between flush water level WL2 outside water reservoir 40 and flush water level wl2 inside water reservoir 40 (whereby the water level outside water reservoir 40 is higher than the water level inside water reservoir 40) are constrained when water is first supplied after installation (post-manufacture) to a water reservoir 40 in an empty state. Therefore buoyancy forces acting on water reservoir 40 can be constrained, and floating up of flush water volume regulator 38 leading to separation from overflow pipe 22*a* can be prevented.

In addition, an opening 40*a* is formed on the bottom surface of a water reservoir 40, so water pressure on opening 40*a* can act essentially uniformly on the valve body 44 of shutoff valve 42. Therefore the valve body 44 of opening-closing valve 42 can be smoothly moved in the vertical direction, opening 40*a* can be opened to an essentially uniform size in all directions, flush water can be reliably flowed into water reservoir 40, and flush water inside water reservoir 40 can be reliably circulated with flush water inside flush water tank 16 located outside water reservoir 40.

Figure 9:
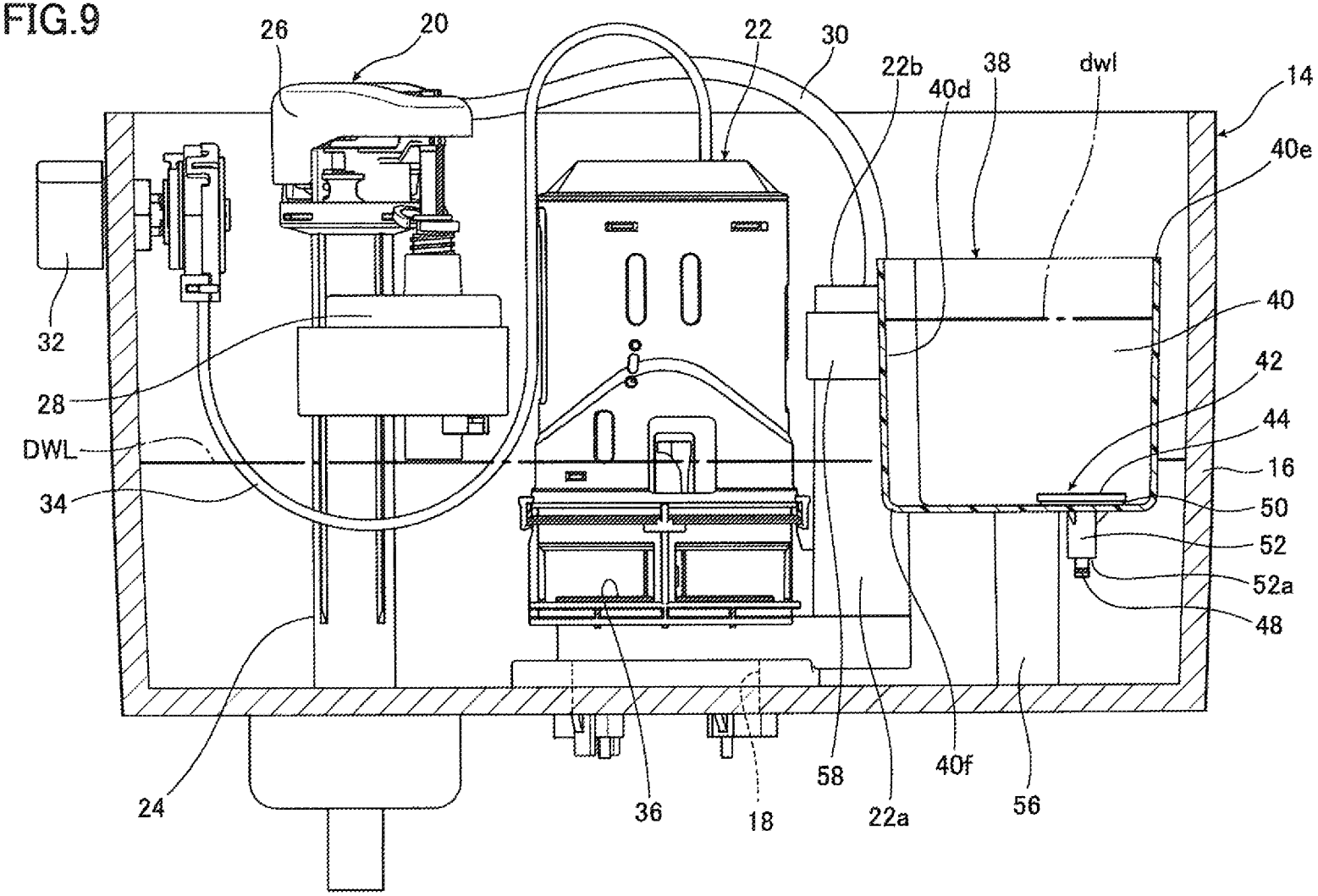
FIG. 9 is a front elevation cross section showing a flush water tank apparatus comprising a flush water volume regulator when the discharge valve has changed from an open state to a closed state during a flush operation, according to an embodiment of the present invention.
Figure 10:
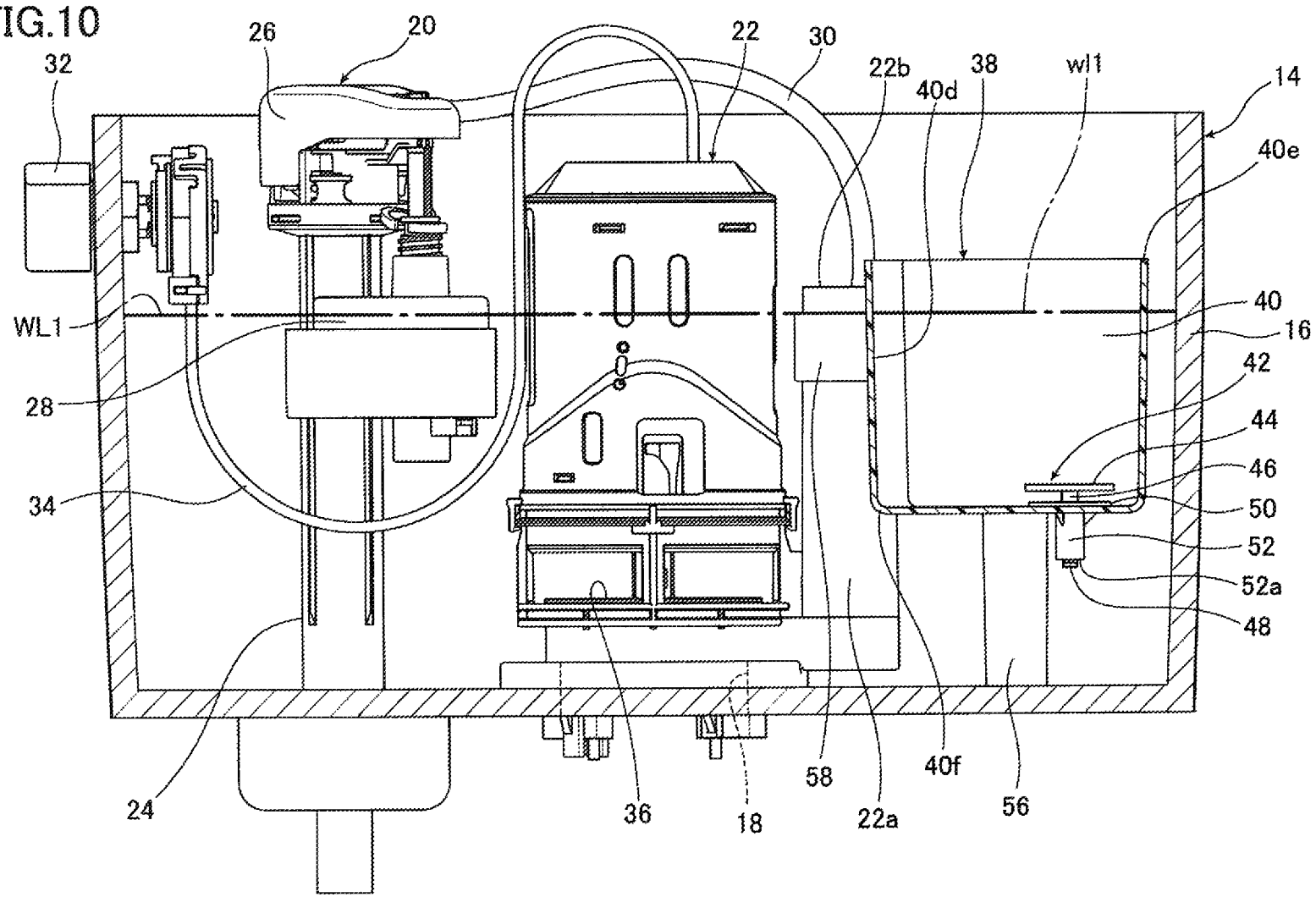
FIG. 10 is a front elevation cross section showing a flush water tank apparatus comprising a flush water volume regulator in the water supplying state after the discharge valve is closed, according to an embodiment of the present invention.

Next, referring to FIG. 3 and FIGS. 9 and 10, we explain the operation (action) of a flush water volume regulator, a flush water tank apparatus comprising this flush water volume regulator, and a flush toilet comprising this flush water tank apparatus, according to an embodiment of the present invention.

FIG. 9 is a front elevation cross section showing a flush water tank apparatus comprising a flush water volume regulator when the discharge valve has changed from an open state to a closed state during a flush operation according to an embodiment of the present invention; FIG. 10 is a front elevation cross section showing a flush water tank apparatus comprising a flush water volume regulator when supplying water after the discharge valve is closed, according to an embodiment of the present invention.

In FIG. 10, with water being supplied, the water level inside the flush water tank is shown by WL1, and the water level inside the water reservoir is shown by wl1.

Note that of the two flushing modes executed by a flush water tank apparatus 14 comprising a discharge valve apparatus 22 according to an embodiment of the invention, the large flush mode and the small flush mode, the basic operations are the same for the large flush mode and the small flush mode except that the amount by which discharge valve apparatus 22 discharge valve body 36 is pulled up by operating wire 34 in the large flush mode is greater than in the small flush mode, so that the flush water tank 16 discharge port 18 release time is longer, and the dead water level DWL (dead water level dwl) is lower during large flush mode than during small flush mode; we therefore shall explain only the large flush mode.

As shown in FIG. 3, in the standby state before the start of discharge by discharge valve apparatus 22 (before a flush is started), the discharge valve body 36 on discharge valve apparatus 22 is closing off discharge port 18, and the initial water level inside flush water tank 16 is at the full water level WL0, while the initial water level inside water reservoir 40 is at the full water level wl0. Float portion 28 is in a risen state, and flush water supply apparatus 20 water supply valve 26 is in a closed state.

Flush water volume regulator 38 is disposed at a position such that the top edge 40*e* thereof projects from the water's surface, and the initial full water level wl0 of flush water in water reservoir 40 is equal to full water level WL0.

Opening-closing valve 42 valve body 44 is in a state whereby hook portion 48 contacts the bottom end 52*a* of cylinder portion 52, and is maintained at a predetermined risen height (the height resulting in opening surface area A2), opened so that flush water in water reservoir 40 can be circulated by a back and forth movement with the flush water in flush water tank 16, located outside water reservoir 40.

Next, as shown in FIGS. 8 and 9, the flushing operation is started when a user operates operating lever 32; discharge valve apparatus 22 releases discharge port 18 in flush water tank 16, and a large flush discharge to flush toilet 1 toilet main unit 2 is started by the discharge valve apparatus 22 on flush water tank apparatus 14, resulting in a drop in the water level inside flush water tank 16.

As shown in FIG. 8, when the water level inside flush water tank 16 starts to drop, the flow F1 of flush water seeking to flow out from water reservoir 40 through opening surface area (A1) in opening 40*a* becomes larger than the flow F2 of flush water seeking to flow out through opening surface area (A2) between valve body 44 and sheet portion 50. Therefore the valve body 44 on opening-closing valve 42 is pulled onto opening 40*a* in water reservoir 40, and opening 40*a* is closed, or the opening surface area of opening 40*a* is reduced (in FIG. 8, the state in which valve body 44 is pulled onto sheet portion 50 and opening 40*a* is closed, shown by a dot and dash line). Therefore flush water inside water reservoir 40 is maintained at an essentially unchanging water level.

While the water level inside flush water tank 16 is dropping, flush water inside water reservoir 40 flows out by a small amount at a time from small opening 44 of valve body 44, but because the amount of outflowing flush water is small, the drop in the level of flush water inside water reservoir 40 is constrained to a range of, for example, a few millimeters. Thus the drop in flush water level inside water reservoir 40 is more constrained when opening-closing valve 42 is installed than when opening-closing valve 42 is not installed. As a result of constraining the drop in the flush water level inside water reservoir 40, the occurrence of a relatively large buoyancy force in water reservoir 40 can be constrained when the flush water level outside water reservoir 40 is rising, as described below.

Thus while the water level inside flush water tank 16 is dropping, the drop in the flush water level inside water reservoir 40 either does not change or is constrained to a relatively small range.

When the water level inside flush water tank 16 drops and float portion 28 falls, water supply valve 26 is thereby opened, and spouting of water from the water spouting port begins.

Next, as shown in FIG. 9, when the water level inside flush water tank 16 drops to dead water level DWL, discharge valve apparatus 22 closes the discharge port 18 on flush water tank 16. Discharge in the large flush mode to toilet main unit 2 of flush toilet 1 by discharge valve apparatus 22 is thus completed. During this interval, float portion 28 is in a dropped state, water supply valve 26 is opened, and supplying of water to flush water tank 16 by flush water supply apparatus 20 continues, therefore the water level inside flush water tank 16 rises from dead water level DWL.

When the water level inside flush water tank 16 is at dead water level DWL, the valve body 44 on opening-closing valve 42 is still closing off opening 40*a*, and dead water level dwl inside water reservoir 40 either does not change or is constrained to a relatively small range compared to full water level wl0 in water reservoir 40. Thus from the start of the flush water tank apparatus 14 discharge operation (start of the flush operation) until completion of the discharge operation (completion of the flush operation), opening-closing valve 42 valve body 44 closes off opening 40*a*.

When the water level outside water reservoir 40 is at dead water level DWL, flush water is present inside water reservoir 40 up to water level dwl, therefore the buoyancy force acting on water reservoir 40 is relatively small, and is insufficient to cause water reservoir 40 to float upward. At this point a downward load is imposed by the flush water at the dead water level dwl, and water reservoir 40 is supported by load support member 56, and disposed in a stable state.

As shown in FIG. 10, when supplying of water from flush water supply apparatus 20 is continued and the water level rises (water level WL1) after discharge valve apparatus 22 discharge valve body 36 closes discharge port 18 and discharge to toilet main unit 2 is completed (the toilet main unit 2 flush operation is completed), opening 40*a* on water reservoir 40 is released, since valve body 44 is formed of a material with a lower specific gravity than water and therefore rises. Opening 40*a* is formed on the bottom surface of water reservoir 40, so water pressure on opening 40*a* can act essentially uniformly on valve body 44. Therefore the valve body 44 on opening-closing valve 42 can be smoothly moved in the vertical direction, opening 40*a* can be opened to an essentially uniform size in all directions, flush water can be reliably flowed into water reservoir 40, and the flush water inside water reservoir 40 can be reliably circulated with the flush water inside flush water tank 16 located outside water reservoir 40.

Even if the water level inside water reservoir 40 were to fall slightly, flush water can be made to flow in through opening 40*a* from outside the water reservoir so that when water is being supplied, the speed at which the level of flush water supplied by flush water supply apparatus 20 outside water reservoir 40 rises will be essentially the same as the speed at which the level of flush water inside water reservoir 40 rises. Therefore differences between the flush water level WL1 outside water reservoir 40 and the flush water level wl1 inside water reservoir 40 (whereby the water level outside water reservoir 40 is higher than the water level inside water reservoir 40) can be constrained, and buoyancy forces acting on water reservoir 40 can be constrained.

In addition, when the supply of water from flush water supply apparatus 20 is continued and the water level rises, float portion 28 also rises, causing water supply valve 26 to close, thereby closing the water spouting port. By this means the level of flush water inside flush water tank 16 is maintained at a predetermined full water level WL0. At this point the water level inside water reservoir 40 is also at the same full water level wl0.

When the level of flush water inside flush water tank 16 reaches the full water level and water supply valve 26 closes, the series of flush operations by flush water tank apparatus 14 is completed, and the apparatus returns to a standby state.

In the above-described flush water volume regulator 38 according to an embodiment of the invention, in a state in which the water level inside flush water tank 16 is dropping after the start of a flush, opening-closing valve 42 either blocks off opening 40*a* or reduces the opening surface area of opening 40*a*. Therefore the drop in the level of flush water inside water reservoir 40 can be constrained more than drop in the level of flush water inside water reservoir 40 when no opening-closing valve 42 is provided on opening 40*a*. Hence in the present invention when water supply apparatus 20 supplies water and the water level inside flush water tank 16 rises, the occurrence of a buoyancy force acting on water reservoir 40 can be constrained, and the floating up of water reservoir 40 and separation thereof from the attachment position as a result of being subjected to a buoyancy force can be prevented. In addition, in the present invention in the standby state before opening-closing valve 42 starts a flush, opening 40*a* is left open, so flush water in water reservoir 40 can be circulated with flush water in flush water tank 16 outside water reservoir 40. Therefore flush water inside water reservoir 40 can be circulated with flush water inside flush water tank 16 located outside water reservoir 40, so as not to stagnate. Flush water volume regulator 38 is therefore able to constrain the occurrence of a buoyancy force acting on water reservoir 40, and flush water inside water reservoir 40 can be circulated with flush water inside flush water tank 16 located outside water reservoir 40.

In addition, using flush water volume regulator 38 according to the embodiment, an opening 40*a* is formed on the bottom surface of water reservoir 40, therefore the water pressure on opening 40*a* can be applied uniformly to opening-closing valve 42, so that opening-closing valve 42 can be smoothly moved, flush water inside water reservoir 40 can be reliably flowed in, and flush water inside water reservoir 40 can be reliably circulated with flush water inside flush water tank 16 on the outside of water reservoir 40.

Moreover, according to flush water volume regulator 38 of the present embodiment, the opening 40*a* on water reservoir 40 has an opening surface area A1 such that when first supplying water during first use of flush water tank apparatus 14, the rise speed of the flush water level supplied by flush water supply apparatus 20 on the outside of water reservoir 40 can be made essentially the same as the rise sped of the flush water level inside water reservoir 40. Therefore flush water is able to flow in through opening 40*a* from the exterior of water reservoir 40. The present invention can therefore suppress the occurrence of water level differences between the level of flush water outside water reservoir 40 and the level of flush water inside water reservoir 40, the occurrence of buoyancy force acting on water reservoir 40 can be constrained, and the problem of water reservoir 40 rising due to buoyancy force and separating from the attachment position can be constrained.

Also, according to flush water volume regulator 38 of the embodiment, when a flush is started and flush water is discharged from flush water tank 16, the flow of flush water seeking to flow out from water reservoir 40 through the opening surface area (A1) of opening 40*a* exceeds the flow of flush water seeking to flow out through the opening surface area (A2) between the valve body 44 in opening-closing valve 42 and the sheet portion 50 on the inside bottom surface 40*b* of water reservoir 40. Therefore opening-closing valve 42 is pulled onto the opening 40*a* in water reservoir 40, either closing off opening 40*a* or reducing the surface area of opening 40*a*.

According to flush water volume regulator 38 of the embodiment, the valve body 44, etc. of opening-closing valve 42 is constituted by a member with a specific gravity lighter than water, therefore opening 40*a* can be reliably opened in the standby state before the start of a flush, and flush water inside water reservoir 40 can be reliably circulated with flush water inside flush water tank 16 located outside water reservoir 40.

According to flush water volume regulator 38 of the present embodiment, a small hole 44*a* is formed on opening-closing valve 42 to communicate between the inside and outside of water reservoir 40. Therefore even if by some chance opening-closing valve 42 valve body 44 ceases to operate while stuck in the closed state on sheet portion 50 of water reservoir 40 due to scale or debris in the water, etc., flush water inside water reservoir 40 can circulate with water on the outside of water reservoir 40 through this small hole 44*a*. Since a small hole 44*a* is formed in the valve body 44 of opening-closing valve 42, the presence or absence of small holes, or changes in the size thereof, etc. can be easily accomplished by exchanging opening-closing valve 42 with a opening-closing valve having no small hole 44*a*, or a with a opening-closing valve having a small hole 44*a* of a different size, etc.

Also, according to flush water volume regulator 38 of the embodiment, the top edge 40*e* of side surface 40*d* on water reservoir 40 extends by a predetermined distance to above the expected full water level WL0, and the bottom edge 40*f* of side surface 40*d* on water reservoir 40 extends by a predetermined distance to below the expected dead water level DWL. Therefore even if full water level WL0 fluctuates up and down, that full water level WL0 is disposed between the top edge 40*e* and bottom edge 40*f* of the side surface 40*d* of water reservoir 40, and even if dead water level DWL fluctuates up and down, that dead water level DWL is disposed between the top edge 40*e* and bottom edge 40*f* of the side surface 40*d* of water reservoir 40. The present invention thus enables reliable regulation of the expected volume of flush water according to the external shape of water reservoir 40.

According to the flush water volume regulator 38 of the present embodiment, load support member 56 can support the load of water reservoir 40 and stably support water reservoir 40.

According to flush water volume regulator 38 of the present embodiment, a flush water tank apparatus 14 comprising a flush water volume regulator 38 can be provided in which the occurrence of buoyancy force acting on water reservoir 40 can be constrained, and flush water inside water reservoir 40 can be circulated with flush water inside the flush water tank 16 located outside water reservoir 40.

Also, according to flush water volume regulator 38 of the present embodiment, a flush toilet having a flush water tank apparatus 14 comprising a flush water volume regulator 38 can be provided with which the occurrence of buoyancy force acting on water reservoir 40 can be constrained, and flush water inside water reservoir 40 can be circulated with flush water inside the flush water tank 16 located outside water reservoir 40.

What is claimed is:

1. A flush water volume regulator capable of regulating a volume of flush water discharged from a flush water tank apparatus to a toilet, the flush water volume regulator being disposed on the flush water tank apparatus, the flush water tank apparatus including:

a water supply apparatus configured to supply flush water into a flush water tank from a water source for flushing the toilet; and a discharge valve apparatus configured to open and close a discharge flow path communicating with the toilet, the discharge valve apparatus being disposed on a bottom surface of the flush water tank, the flush water volume regulator comprising:

a water reservoir disposed inside the flush water tank and capable of storing a predetermined quantity of flush water, the water reservoir including an opening through which the flush water in the water reservoir and the flush water outside the water reservoir can flow; and an opening-closing valve configured to release the opening in a standby state prior to starting a flushing of the toilet, and the opening-closing valve being configured to block off the opening or to reduce an opening surface area of the opening when a flush water level in the flush water tank is dropping after the flushing of the toilet is started, wherein a small hole is formed in the opening-closing valve such that an inside of the water reservoir and an outside of the water reservoir communicate with each other by the small hole while the opening-closing valve closes the opening of the water reservoir.

2. The flush water volume regulator of claim 1, wherein the opening is formed in a bottom surface of the water reservoir.

3. The flush water volume regulator of claim 1, wherein the opening surface area includes an opening surface area (A1) of the opening in the water reservoir such that a rise speed of the flush water level in the flush water tank outside the water reservoir becomes the same as a rise speed of a flush water level in the water reservoir.

4. The flush water volume regulator of claim 1, wherein the opening surface area includes an opening surface area (A1) of the opening in the water reservoir and an opening surface area (A2) between the opening-closing valve and a bottom surface of the water reservoir such that the opening surface area (A1) is larger than the opening surface area (A2) when the opening-closing valve releases the opening.

5. The flush water volume regulator of claim 1, wherein the opening-closing valve includes a member with a specific gravity lighter than water.

6. The flush water volume regulator of claim 1, wherein a top edge of a side surface of the water reservoir is positioned a predetermined distance above an expected full water level inside the flush water tank in the standby state before the flushing of the toilet is started, and a bottom edge of the side surface of the water reservoir is positioned a predetermined distance below an expected dead water level of the flush water inside the flush water tank immediately after completion of the flushing of the toilet.

7. The flush water volume regulator of claim 1, wherein the water reservoir includes a load support member for supporting a load of the water reservoir at a position of the center of gravity on a bottom surface of the water reservoir.

* * * * *